United States Patent [19]

Dahms

[11] Patent Number: 4,909,983

[45] Date of Patent: Mar. 20, 1990

[54] METHOD OF PRODUCING INTERMETALLIC PHASES FROM POWDERY DUCTILE COMPONENTS

[75] Inventor: Michael Dahms, Geesthacht, Fed. Rep. of Germany

[73] Assignee: GKSS-Forschungszentrum Geesthacht GmbH, Geesthacht, Fed. Rep. of Germany

[21] Appl. No.: 375,965

[22] Filed: Jul. 5, 1989

[30] Foreign Application Priority Data

Jul. 5, 1988 [DE] Fed. Rep. of Germany ..... 3822686

[51] Int. Cl.[4] ..... B22F 1/00

[52] U.S. Cl. ..... 419/38; 419/39; 419/41; 419/45; 419/48; 419/67

[58] Field of Search ..... 419/38, 39, 41, 45, 419/48, 67

[56] References Cited

U.S. PATENT DOCUMENTS

| | | | |
|---|---|---|---|
| 3,155,502 | 11/1964 | Brown | 75/214 |
| 3,602,977 | 9/1971 | Jamioulx et al. | 29/420 |
| 4,640,816 | 2/1987 | Atzmon et al. | 419/24 |
| 4,762,679 | 8/1988 | Gegel et al. | 419/28 |

*Primary Examiner*—Stephen J. Lechert, Jr.
*Assistant Examiner*—Leon Nigohosian
*Attorney, Agent, or Firm*—Robert W. Becker & Associates

[57] ABSTRACT

A method of producing intermetallic phases from powdery ductile components that are mixed in a predetermined mixture ratio and are subsequently precompacted by cold pressing. Subsequently, the precompacted components are pressed, via compaction, to such an extent that the degree of deformation is greater than 80%; thereafter, the thus-produced material is thermally treated.

9 Claims, No Drawings

METHOD OF PRODUCING INTERMETALLIC PHASES FROM POWDERY DUCTILE COMPONENTS

BACKGROUND OF THE INVENTION

The present invention relates to a method of producing intermetallic phases, e.g. alloys, from powdery ductile components that are mixed in a predetermined mixture ratio and are subsequently precompacted by cold pressing.

It is known to form intermetallic phases from alloys that essentially comprise titanium/aluminum, and that have a relatively good ductility at room temperature and a good creep strength, as a function of time, at high temperature; these known alloys can be cast and forged (German Offenlegungsschrift No. 30 24 645). Alloys of this type are used, for example, in jet drive plants as the starting material for the production of turbines, where high tensile strength, high ductility, high modulus of elasticity, high fatigue limit or creep strength, resistance to oxidation, and low density are of importance. Another application for such alloys is, for example, during the production of tools and motor components, where again the aforementioned properties are of importance.

Exhaustive tests have shown that a drawback of these heretofore known alloys is that they have a heterogeneous rather than a homogeneous structure, so that the expectations for the desired applications are not fulfilled. A further drawback of the previously known alloys of this type is their poor reproducibility with regard to the aforementioned properties, and also the fact that only very small quantities can be produced with the heretofore conventional methods of smelting.

Intermetallic phases, especially in the cast state, are brittle, so that they are customarily worked or shaped by hot process extrusion presses at very high temperatures. The tools that take part in this are stressed very greatly. An expensive furnace technology is required. Even laboratory furnaces that enable temperatures of up to 1350° C. to be obtained are extremely expensive. A laboratory furnace for 1600° C. costs approximately $10,000.00. An alloy such as TiAl is extruded, for example, at 1400° C.

The forging process provides a heterogeneous structure, since the sample undergoes varying stress. In addition, it is possible to process only individual components during the forging. For greater quantities of samples, a greater expenditure is therefore necessary than during extrusion.

It is an object of the present invention to provide a method with which the aforementioned drawbacks are eliminated, and in particular any desired reproducibility of the required alloys can be achieved, whereby it is also possible to produce any desired quantity of the desired alloy in a single process phase.

This object, and other objects and advantages of the present invention, will appear more clearly from the following specification and examples.

SUMMARY OF THE INVENTION

The method of the present invention is characterized primarily by pressing the precompacted components, via compaction, to such an extent that the degree of deformation is greater than 80%, and thereafter thermally treating the thus-produced material.

The advantage of the method of the present invention is essentially that the material produced thereby has a homogeneous structure, whereby in contrast to heretofore known materials of this type, the toughness of ductility can be significantly increased. As strived for, any desired reproducibility of alloys is possible with the inventive method, and the alloys can be produced in any desired quantities with continuously uniform predetermined properties.

Pursuant to one advantageous specific feature of the inventive method, the compaction of the component mixture is effected by extrusion and/or extrusion molding. In other words, the inventive method can be utilized with different pressing or compressing processes, depending upon need and the type of press that is available for the production of the alloy. The ductile powder particles are elongated, resulting in a fresh surface (free of oxide). The particles can fuse together. In addition, the diffusion path becomes smaller during the transition from powder particles to filaments.

Pursuant to another advantageous specific embodiment of the inventive method, the compaction of the particles that form the components is effected at an increased temperature below the temperature at which the particles react with one another to form a homogeneous material. The pressing forces are less, and the method can be carried out with smaller presses.

It is preferably also possible to carry out the compaction of the particles that form the components at a temperature above the temperature at which the particles react with one another to form a homogeneous material, whereby in particular with this type of embodiment of the method the individual powder particles deform greatly, as a result of which a very homogeneous structure of the material that is formed is achieved. In addition, a thermal treatment step is dispensed with.

Pursuant to a further specific embodiment of the inventive method, processing of the material that is formed can be effected between the compacting step and the thermal treatment step, for example in the form of removal of metal. The structure is further improved or refined, and the final shape of the component is approached. With ductile materials, removal of metal is an easy type of machining. For example, a turbine blade can be produced from a round rod.

The thermal treatment is preferably effected in at least one stage at a maximum temperature of the material that is below the solidus temperature. The entire temperature range is covered. However, solid particle reactions are still possible. Finally, pursuant to a further advantageous specific embodiment of the inventive method, the thermal treatment can be effected under pressure. During the reaction of the powder particles, pores are frequently formed that can be closed by pressure.

It should be noted that the inventive method permits the production of intermetallic phases of super alloys that are difficult to machine via the removal of metal.

The method of the present invention will now be described by the individual steps pursuant to a typical embodiment of the invention.

First, the powdery ductile components, which are present in elementary or prealloyed form, are mixed in a predetermined mixture ratio. Subsequently, this powdery mixture is precompacted by a uniaxial or isostatic cold pressing, whereby this cold pressing is effected at temperatures at which the powdery components do not yet react with one another.

Pursuant to the present invention, the precompacted powdery components are now compressed or compacted by extrusion or extrusion molding, and in particular to a degree of deformation of greater than 80%. This process too can be effected cold, i.e. at temperatures at which the powder components do not yet react with one another, or can be effected warm. If necessary, the compacted material can already now be further deformed or shaped, and in particular can be provided with a desired shape or can be machined by removing metal.

A thermal treatment is subsequently effected, and takes place in at least one stage. The thermal treatment can be carried out without using pressure (annealing) or under pressure (hot isostatic pressure), whereby the temperature of the thermal treatment is less than the solidus temperature of the alloy that is formed. In accordance with the prescribed process, it is possible with the present invention to produce any alloys or materials where all of the pulverous components are ductile. Depending upon the pressure that is available for carrying out the method, it is also possible to introduce brittle powdery components into the component mixture, with such brittle components breaking rather than being deformed during the pressing operation. It should be noted that the thermal treatment by annealing can also be carried out under oxidizing conditions. Thus, for example, it can be possible pursuant to the inventive method to produce high temperature superconductors in wire form. It is thus possible pursuant to the present invention to be able to produce large quantities of intermetallic phases under controlled reproducible conditions. The material that is formed has a uniform homogeneous structure. Pursuant to the inventive method, the extrusion is carried out on ductile phases and can thus also take place at room temperature. With the inventive method, profiled articles can be produced that are capable of being further shaped and further machined, so that desired accurately measured workpieces can be produced.

The following intermetallic phases are examples of what can be produced with the method of the present invention:

High temperature materials:

NiAl, CoAl, NiAlCr, $Co_2TiAl$, $NbAl_3$, NbNiAl, TiAl, $Ti_3Al$, $Ni_3Al$

Alloys with a memory:

CuZnAl, NiTi

Superconductors:

$Nb_3Sn$ in a copper matrix

Aluminum containing intermetallic phases that are ductile are particularly suitable.

However, it is also possible to produce alloys having a final content in a brittle phase if the other components are ductile enough.

The present invention is, of course, in no way restricted to the specific disclosure of the specification and examples, but also encompasses any modifications within the scope of the appended claims.

What I claim is:

1. A method of producing intermetallic phases from powdery ductile components that are mixed in a predetermined mixture ratio and are subsequently precompacted by cold pressing, said method including the further steps of:

subsequently pressing said precompacted components, via compaction, to such an extent that the degree of deformation is greater than 80%; and thereafter thermally treating the thusproduced material.

2. A method according to claim 1, in which said compaction is effected by at least one of the processes of extrusion and extrusion molding.

3. A method according to claim 1, in which said compaction of the particles that form the components is effected at an increased temperature that is below that temperature at which said particles react with one another to form a homogeneous material.

4. A method according to claim 1, in which said compaction of the particles that form the components is effected at a temperature that is above that temperature at which said particles react with one another during said pressing step to form a homogeneous material.

5. A method according to claim 1, which includes the additional step of working and/or machining said material between said pressing and thermal treatment steps.

6. A method according to claim 5, in which said additional step is a metal removal machining operation.

7. A method according to claim 1, in which said thermal treatment step is carried out in at least one stage at a maximum temperature that is below the solidus temperature of said material.

8. A method according to claim 1, in which said thermal treatment step is carried out under pressure.

9. A method according to claim 1, which permits the production of intermetallic phases of super alloys that are difficult to machine by metal removal.

* * * * *